United States Patent [19]

Mazzone

[11] Patent Number: 4,884,479

[45] **Date of Patent: * Dec. 5, 1989**

[54] WRENCH WITH RACK AND SEGMENT GEAR LINKAGE

[76] Inventor: Thomas J. Mazzone, 4016 Audubon Dr., Largo, Fla. 34641

[ * ] Notice: The portion of the term of this patent subsequent to Jan. 10, 2006 has been disclaimed.

[21] Appl. No.: 215,242

[22] Filed: Jul. 5, 1988

Related U.S. Application Data

[63] Continuation of Ser. No. 184,270, Apr. 21, 1988, Pat. No. 4,797,965.

[51] Int. Cl.[4] ..... B25B 13/12

[52] U.S. Cl. ..... 81/128; 81/356; 81/362; 81/384

[58] Field of Search ..... 81/126–128, 81/356, 362, 384

[56] References Cited

U.S. PATENT DOCUMENTS

| | | | |
|---|---|---|---|
| 2,156,529 | 5/1939 | Day | 87/127 X |
| 2,481,866 | 9/1944 | Petersen | 87/356 |
| 2,605,663 | 8/1952 | Aden | 87/362 |
| 2,650,511 | 9/1953 | Aden | 87/356 |
| 2,827,814 | 3/1958 | Israel | 87/127 X |
| 3,290,970 | 12/1966 | De Lucia | 87/127 |
| 3,608,405 | 9/1971 | Schmidt | 87/356 |
| 4,094,215 | 6/1978 | Hudson | 87/127 |
| 4,274,312 | 6/1981 | Finn | 87/356 |

*Primary Examiner*—James G. Smith

[57] ABSTRACT

A wrench of the type having one handle member connected to a pivotal arm member at a pivot point. The handle member, and the pivot arm member terminate in a jaw member, the jaw in the handle member being fixed. Advancing a screw member causes the pivot arm member to rotate about the pivot point so that the jaw members are brought together. A pair of slots translate the rotating motion of the pivot arm member about the pivot point into linear components. The jaw member at the end of the handle member and the pivot arm member are biased apart from one another by a spring, but the bias may be overcome by squeezing the handle and pivot arm member or by advancing the screw member. When the screw member is fully retracted, the spring separates the jaw members. When the screw member is advanced, it prevents separation of the jaw members.

24 Claims, 2 Drawing Sheets

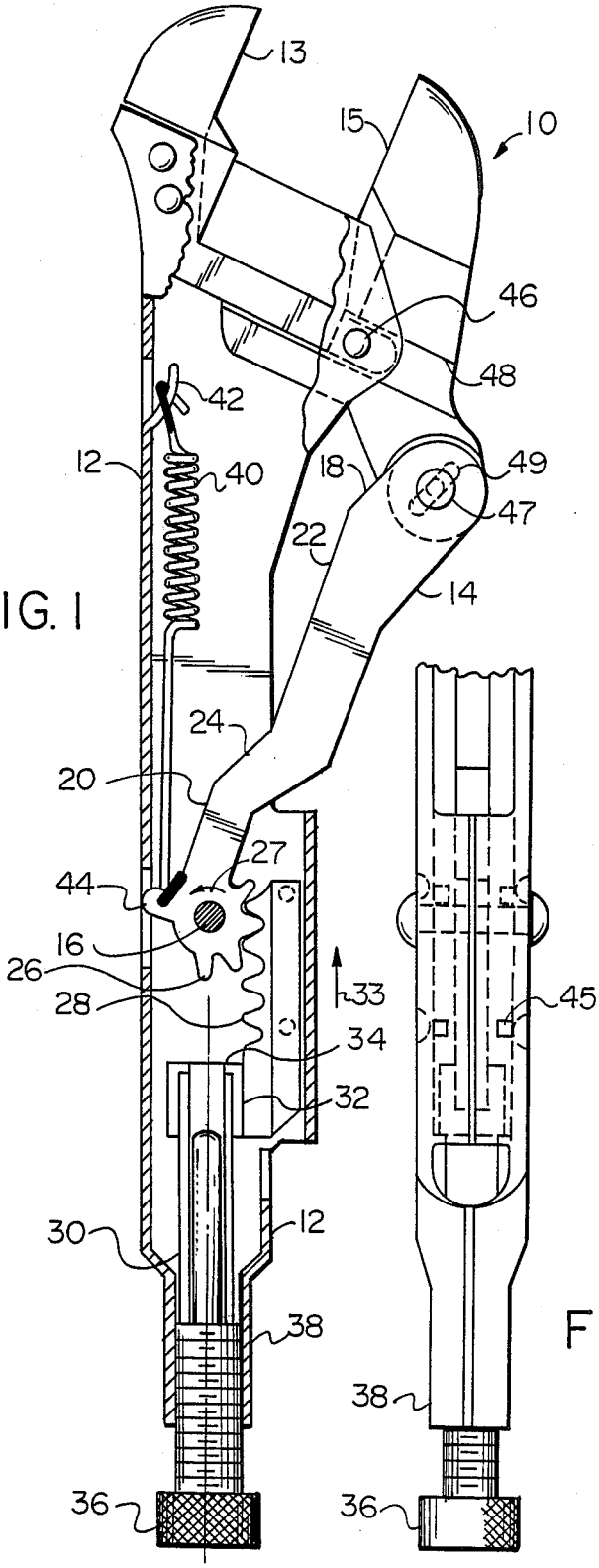
FIG. 1
FIG. 1A
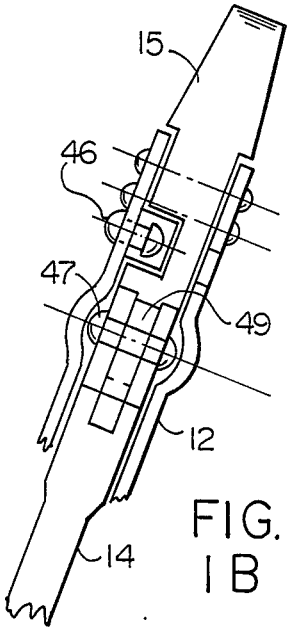
FIG. 1B

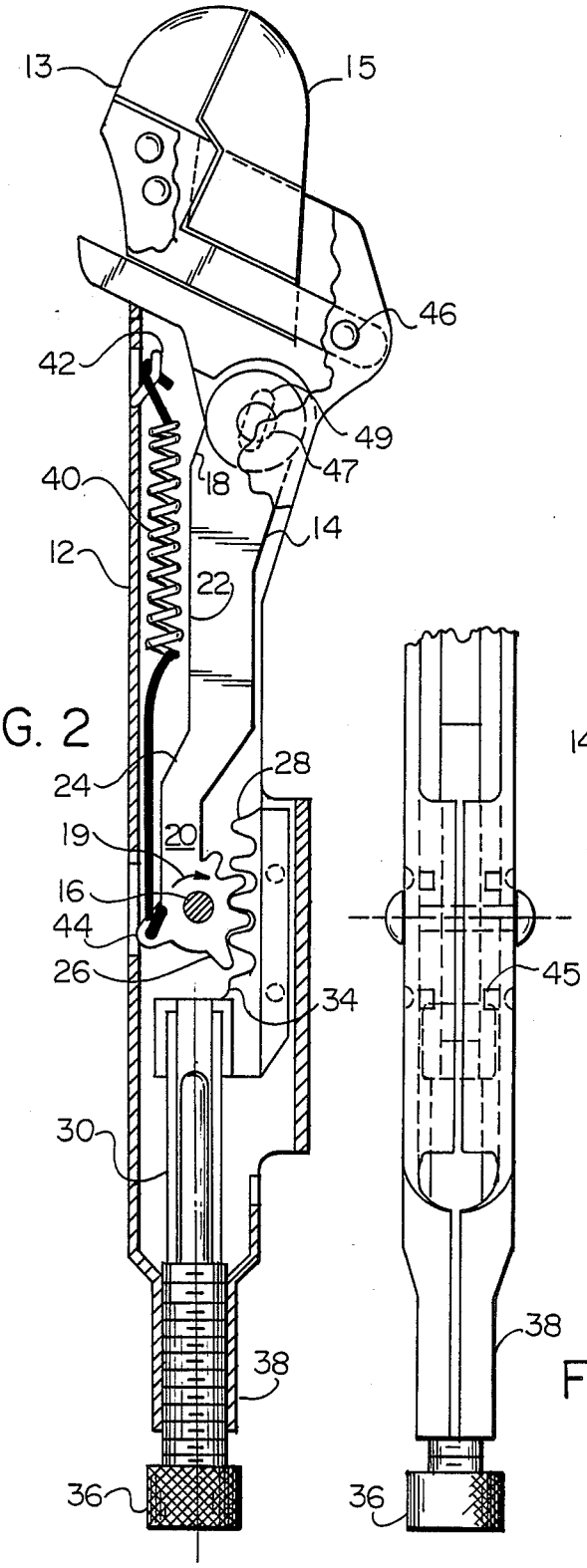
FIG. 2
FIG. 2A
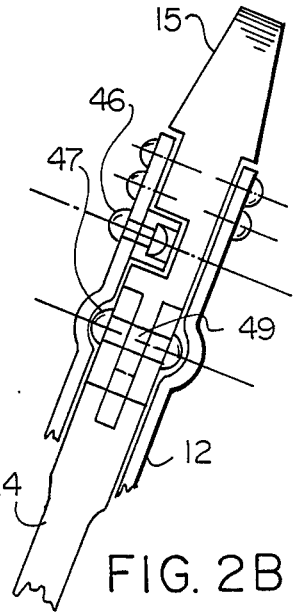
FIG. 2B

WRENCH WITH RACK AND SEGMENT GEAR LINKAGE

PREAMBLE

This application is a continuation of the application of the invention entitled 'WRENCH WITH RACK AND SEGMENT GEAR LINKAGE' filed on 4/21/88, file #184270 now U.S. Pat. No. 4,797,965; it relates to the simplification and reduction of parts required to create the novel wrench.

In the disclosure one of the two handles has been eliminated, leaving one handle. The coil spring has been replaced by a tension spring.

The novel wrench will operate with either type spring, however, the wrench will be more economical to manufacture with less parts and therefore more desirable as a hand tool.

BACKGROUND OF THE INVENTION

1. Field of the Invention

This invention relates, generally, to wrenches; more particularly, it relates to a wrench having jaws that may be locked into any desired position relative to one another by advancing a screw member.

2. Description of the prior art

Lever-actuated pivoted jaw wrenches are shown in U.S. Pat. Nos. 1,862,817 to Eifel (1932); 2,201,918 to Petersen (1940), 2,280,005 to Petersen (1942), 2,489,895 to Kash (1949), 2,496,308 to Pugh and others (1950), 2,589,511 to Redmon (1952) and 4,478,114 to Arens (1984).

The devices of the prior art perform their intended function, but are characterized by complex constructions which are not economical to manufacture.

The art teaches the use of a construction often referred to as an "overcenter" or "cam over center" construction. In such type of wrenches, a movable handle member is pivoted about a point such that once it has pivoted past the point, it cannot thereafter be forced open at the point where it meets its unpivoted counterpart. Essentially, the fulcrum of the lever (the movable handle) is positioned off center so that, once the lever is pivoted therepast, the location of the fulcrum prevents facile return of the lever (handle) to its original position Overcenter designs have utility, but, again, tend to be structurally complex. Accordingly, there is a need for a wrench of simple, non-overcenter design that operates as well as an overcenter design.

The prior art neither teaches nor suggests new designs that could provide an elegantly constructed wrench capable of performing as well as the prior art tools.

SUMMARY OF INVENTION

The longstanding need for an improved wrench design is now provided in the form of a tool having a novel rack and segment gear assembly that eliminates many of the parts employed in earlier designs.

The novel wrench has one handle that incorporates a pivot point for the pivotal arm. It is unique and novel in its simplicity. The structure embodies all its members.

A jaw member is provided at the proximal end of each pivoted member; one of the jaw members is movable and the other has a fixed position.

The rack gear of this invention is a part of the handle member and is slideably mounted with respect thereto; a segment gear meshingly engages the rack gear and is a part of the movable arm member, being integral with a rigid pivot arm member that extends from a forward or proximal portion of the movable arm member to a rearward or distal portion thereof.

The segment gear is coincident with the pivot point that interconnects the pivotal members of the wrench; the rack gear engaged thereby has a distal position on a first or remote side of the pivot point and a second or proximal position on a second side of the pivot point.

A screw member is received in the distal portion of the handle member of the tool. When the screw member is advanced, it drives a slideably mounted tube member that in turn abuts a shoulder formed in said rack gear to thereby drive the rack gear in a distal to proximal direction.

The travel of the rack gear effects rotation of the segment gear; since the segment gear is integral to the pivot arm that interconnects the handle member, the jaws of the wrench are separated from one another when the rack gear is in its distal position but are closed when said rack gear is in its proximal position.

The nut-engaging surfaces of the fixed position jaw member and the movable jaw member are always in parallel alignment with one another; a pair of slot members cooperate to guide the movable jaw member so that it closes toward its counterpart in parallelism with it. Thus, the slots translate the arcuate path of the pivotally mounted arm member into a pair of orthogonal linear components.

A spring member is positioned within and fixed to the handle member at one extremity and fixed to the pivotal arm member at the other extremity and provides a bias means that urges the jaws to separate. The bias is easily overcome by squeezing the pivot arm member or by advancing the screw member.

A primary object of this invention is to provide a wrench of the adjustable jaw type that is safe and easier to use because the operator thereof need not place fingers near the jaws in order to close or open them.

An important object of this invention is also to provide an adjustable jaw wrench of simple, long lasting design.

A specific object is to harness the properties of a rack and segment gear arrangement in an adjustable jaw wrench design.

Another specific object is to provide a wrench having jaws that remain open when the wrench is not in use so that no adjustments need to be made to the wrench at the beginning of a job.

Still further objects are to provide a wrench apparatus that provides alternative means for closing the wrench jaws, and which provides a means for locking the jaws in a closed position when desired.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 1 is an elevational view of the novel wrench, showing its jaws in their separated configuration; FIG.

1A is a partial side view of the lower part of the wrench shown in FIG. 1;

FIG. 1B is a partial side view of the upper part of the wrench shown in FIG. 1;

FIG. 2 is a view similar to FIG. 1, but showing the jaws in their closed configuration;

FIG. 2A is a partial side view of the lower part of the wrench shown in FIG. 2; and FIG. 2B is a partial side view of the upper part of the wrench shown in FIG. 2.

Similar reference numerals refer to similar parts throughout the several views of the drawings.

DETAILED DESCRIPTION OF A PREFERRED EMBODIMENT

Referring now to FIG. 1, it will there be seen that in illustrative embodiment of the invention is denoted by the reference numeral 10 as a whole.

Wrench 10 is depicted with its jaws in their fully separated position in FIG. 1.

Main handle member 12 serves as the base means of the inventive assembly; movable arm member 14 is pivotally mounted to main handle 12 and may be thought of as a lever means.

The pivotal connection between the two members 12 and 14 is denoted 16. Pivot point 16 is a fulcrum means for lever means 14.

Pivot point 16 divides the wrench into a forward, jaw-carrying portion and a distal portion remote therefrom.

Lever means or movable pivot arm member 14 includes two longitudinally spaced, opposite end parallel portions 20, 22 interconnected by an angled medial portion 24 and an oblique medial portion 18 at the opposite end of pivot 16. The offsetting of the longitudinally spaced end portions 20, 22, 18 of pivot arm 14 by said medial portion 24 enhances the force parallel to the slot member 48 facilitating the jaws to open. Moreover, as those skilled in the art of machine design will appreciate, it amplifies the effect of pivoting the movable arm member 14 about pivot point 16, i.e., it provides a mechanical advantage.

End portion 20 of pivot arm 14 terminates in an integral, rotatably mounted segment gear 26 that meshingly engages a rack gear 28 that is slideably mounted on the handle member 12 as shown.

Travel of rack gear 28 causes segment gear 26 to rotate about its axis of rotation, which axis of rotation is also the rotational axis of the pivotal connection 16 between the handle and movable pivot arm members 12 and 14. Since gear 26 is integral to pivot arm 14, rotation of said gear 26 effects pivotal travel of said pivot arm 14.

Rack gear 28 may be actuated by a tube member 30; tube member 30 has a cap means 32 that abuttingly engages a shoulder means 34 formed in rack gear 28. The tube and cap may be separate members or may be integral with shoulder means 34.

Tube member 30, in turn, is actuated by screw member 36 which is screw-threadedly received within tubular portion 38 of the distal portion of main handle member 12 as shown in FIG. 1. Clockwise rotation of the screw member moves the adjustable jaw member toward the fixed jaw member irrespective of the orientation of the wrench.

FIG. 1 depicts screw member 36 in its fully retracted position.

When screw member 36 is fully retracted, the fixed jaw means 13 of main handle 12 and the movable jaw means 15 of movable pivot arm 14 are spaced apart at their maximum separation as shown; such separation is the result of the action of spring member 40 which biases said jaw means 13, 15 into their spaced relation.

The retraction of the screw member 36 allows bias means 40 to separate the jaw members by causing movable arm member 14 to pivot about point 16 which effects rotation of segment gear 26 and hence linear, proximal-to-distal travel of rack gear 28 because rack gear 28 is free to travel in a distal direction when screw member 36 is retracted.

The extremities of the stretched spring member 40 are attached to the crank 44 of pivot arm 14 and the hook member 42 of the handle 12.

The stretched spring member 40 engages pivot arm 14 at crank member 44 as shown in FIG. 1; in this manner, when screw 36 is fully retracted as aforesaid, the bias supplied by spring 40 is essentially unresisted and said jaws means 13, 15 slide apart from one another, always maintaining their parallel assignment, which drives rack gear 28 from its proximal position as shown in FIG. 1 to its distal position as shown in FIG. 2.

The sliding engagement between jaws 13, 15 is perhaps best shown in FIG. 1B. A rivet member 46 slides in a channel 48; a second slot or channel 49 formed in jaw member 15 is disposed at right angles to channel 48; rivet member 47 is slideably mounted in said second slot 49.

Slot members 48 and 49 and their associated rivets cooperate to translate the arcuate movement of pivot arm member 14 into its linear components so that movable jaw member 15 opens or closes in parallelism to fixed jaw member 13.

Advancing screw member 36 advances tube member 30, which in turn advances rack gear member 28 in the direction indicated by directional arrow 33 in FIG. 1. Rack gear member 28 moves in a lineal distal or proximal direction and is prevented by bosses 45 of handle member 12 from turning about the axis of the tube 30.

Once screw member 36 is advanced, rack gear 28 is no longer free to travel in a distal direction under the influence of spring member 40 and as a result jaw members 13, 15 cannot be separated without bending the heavy gauge steel from which they are made.

The advance of screw member 36 drives rack gear 28 in a proximal direction thus constrains segment gear 26 and pivot arm member 14, to rotate in opposition to the direction of directional arrow 27, since they are integral with each other. The advancing of screw member 36 rotates member 14 in the direction of directional arrow 27, thereby relieving the loading spring 40; again, slot members 48 and 49 cooperate to translate the arcuate travel of the handle member 14 into its linear components.

When screw member 36 is fully advanced, jaws 13, 15 are fully closed as depicted in FIG. 2.

As shown in FIG. 2, segment gear 26 now meshingly engages the rearward or distal end of rack gear member 28, and the fixed and movable portions of spring member 40 are now disposed in greater tension to one another.

Jaws 13, 15 cannot separate because tube 30 is held against distal travel by screw member 36. Tube 30 holds rack gear 28 in place, and hence segment gear 26 cannot rotate. The diverging force of spring member 40 is insufficient to overcome the holding power of screw member 36, and the leverage supplied by the medial portion 24 of pivot arm 14 ensures that a nut grasped by jaws 13, 15 will be securely engaged.

Subsequent retraction of screw 36 allows spring 40 to drive pivot arm 14 in the direction of arrow 19. This rotates segment gear 26 so that it can drive rack gear 28 in a proximal to distal direction so that, as the screw 36 is further and further retracted, the position of FIG. 1 is again attained.

Once wrench 10 is in the position of FIG. 1, squeezing the distal ends of the handle member and pivot arm member will cause jaw member 15 to close toward fixed position jaw member 13 in parallel relation thereto as aforesaid, and said jaw members will grasp diametrically opposite flats of a nut positioned therebetween. More specifically, squeezing the handle 12 and pivot arm member 14 at their distal ends when screw 36 is retracted causes rack gear 28 to be driven toward the jaws which proximal travel rotates segment gear 26 and again loads spring 40 in the manner herein described.

Thus, the novel tool provides two means whereby the jaws can be closed.

As long as screw 36 is retracted, however, as depicted in FIG. 1, spring 40 will urge the rack gear 28 to slide back to its distal position when the handle member 12 and pivot arm member 14 are not squeezed. However, once screw member 36 has been advanced as depicted in FIG. 2, the force of spring 40 is insufficient to cause jaws 13, 15 to diverge and the strength of the individual using the tool may be directed to turning a nut rather than to just holding the jaws together.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A wrench having a handle member comprising:

a handle member having a fixed position jaw means formed on its proximal end;

a pivot member arm having a movable jaw means formed on its proximal end;

a pivot point where said handle member and pivot arm member are pivotally connected to one another;

a segment gear member integral with said pivot arm;

a crank member integral with said pivot arm;

a rack gear member that is slideably mounted with respect to said handle member;

said rack gear member having a distal position and a proximal position and a plurality of positions therebetween;

said rack gear member being meshingly engaged with said segment gear member, said segment gear member being constrained to rotate when said rack gear member travels between its distal and proximal positions;

a bias means having a power sufficient to cause said jaw members to separate from one another, which movement effects sliding travel of said rack gear member in a proximal-to-distal direction;

said segment gear having an axis of rotation coincident with said pivot point so that pivoting of said pivot arm member under the influence of said bias means effects simultaneous and corresponding rotation of said segment gear;

and means for overcoming the bias provided by said bias means so that when said jaw members are closed, the power of said bias means is inadequate to separate them.

2. The wrench of claim 1, wherein said means for overcoming said bias includes a stop means that abuts said rack gear member and prevents said rack gear member from traveling in a distal direction under the influence of said bias member.

3. The wrench of claim 2, wherein said stop means includes a tube member that abuts said rack gear member, said tube member in turn being abutted by a screw member that is screw-threadedly received within said first handle member.

4. The wrench of claim 3, wherein said pivot arm includes a proximal portion and a distal portion that are parallel to one another and interconnected by an obliquely disposed medial portion.

5. The wrench of claim 4, wherein said bias means is a spring member in tension having one end fixed to the handle and the opposite end attached to the pivot arm at a point on a radius intersecting the pivot point.

6. The wrench of claim 5, wherein said jaw members are slideably adjustable with respect to their associated handle member and pivot arm member.

7. The wrench of claim 6, wherein nut-engaging surfaces of said jaw members are maintained in parallelism to one another by a paid of orthogonally disposed slot members that translate arcuate travel of said movable handle member into its linear components.

8. A wrench, comprising, a handle member;

a pivot arm member;

a jaw member integral with each of said handle member and pivot arm member at a proximal end thereof;

said handle member and pivot arm member being pivotally connected to one another and being pivotally movable about a pivot point between a first position where said jaw members are spaced apart from one another and a second position where said jaw members are in closely spaced relation to one another;

a bias means for urging said jaw members into said first position;

a segment gear member having an axis of rotation coincident with said pivot point;

a pivot arm member incorporating a segment gear member;

a rack gear member slideably mounted in the handle member between a distal position remote from said jaw members and a proximal position;

said segment gear meshingly engaging said rack gear member;

said pivot point being positioned intermediate a proximal end of said wrench and a distal end of said wrench so that squeezing said handle member and pivot arm member overcomes said bias means and places said jaw members into said second position.

9. The wrench of claim 8, wherein said bias means is a spring member in tension that provides a bias, said spring having an axis that intersects a radius of the said pivot point.

10. The wrench of claim 9, wherein said pivot arm member has a distal end formed to provide said segment gear member, a proximal end secured to a movable jaw member and being disposed parallel to said distal portion, and an offset medial portion interconnecting said proximal and distal portions.

11. The wrench of claim 10, further comprising a stop means for barring proximal to distal travel of said rack gear means.

12. The wrench of claim 11, wherein said stop means includes a screw member threadedly engaged in a distal portion of said handle member.

13. The wrench of claim 12, wherein nut-engaging surfaces of said jaw members are maintained in parallel alignment with each other by a pair of slot members that translate arcuate travel of said movable handle member into linear components.

14. A wrench, comprising, a handle member having a fixed position jaw means formed in a proximal end thereof;

a pivot arm member having a movable jaw means formed in a proximal end thereof;

said handle and pivot arm members being pivotally secured to one another substantially mid-length thereof;

a pivot point means for providing said pivotal interconnection;

a bias means operative to separate the proximal ends of said handle members away from one another;

said pivot point means dividing said wrench into a proximal, jaw-carrying portion and a distal portion;

a linkage means interconnecting said handle member and pivot arm member; and said linkage means including a rack gear member.

15. The wrench of claim 14, wherein said linkage means further includes a segment gear member disposed in meshing relation to said gear member.

16. The wrench of claim 15, wherein said linkage means further includes a pivot arm member that interconnects said handle member.

17. The wrench of claim 16, wherein a distal end of said pivot arm member is formed to provide said segment gear.

18. The wrench of claim 17, wherein said pivot arm is an elongate, rigid link member having parallel opposite ends interconnected by an oblique medial portion to enhance the mechanical advantage of said pivot arm.

19. The wrench of claim 18, wherein said rack gear member is mounted for slideable travel in a distal-proximal direction.

20. The wrench of claim 19, further comprising stop means for preventing proximal-to-distal travel of said rack gear member.

21. The wrench of claim 20, wherein said rack gear member is slideably mounted on said handle member.

22. The wrench of claim 21, wherein said stop means includes a screw member that is screw-threadedly received within said handle member.

23. The wrench of claim 22, wherein said stop means further includes a slideably mounted tubular member actuated by said screw member, said tubular member abutting said rack gear member and stopping proximal-to-distal travel of said rack gear member when said screw member is advanced and said tube member being inoperative to prevent proximal-to-distal travel of said rack gear member when said screw member is retracted.

24. The wrench of claim 23, wherein nut-engaging surfaces of said jaw members are maintained in parallel alignment with one another by means including a pair of channel members disposed at right angles to one another.

* * * * *